United States Patent [19]

Plutsky

[11] Patent Number: 4,514,919

[45] Date of Patent: May 7, 1985

[54] APPARATUS FOR STORING, DISPLAYING AND IDENTIFYING PHOTOGRAPHS

[75] Inventor: Sheldon Plutsky, Chatsworth, Calif.

[73] Assignee: Pioneer Photo Albums, Inc., Chatsworth, Calif.

[21] Appl. No.: 542,404

[22] Filed: Oct. 17, 1983

[51] Int. Cl.[3] ..... A47G 1/06

[52] U.S. Cl. ..... 40/159; 40/391

[58] Field of Search ..... 433/159, 534, 391, 405, 433/124.2

[56] References Cited

U.S. PATENT DOCUMENTS

| | | | |
|---|---|---|---|
| 2,149,488 | 3/1939 | Ainsworth | 40/534 |
| 2,296,272 | 9/1942 | Sherbinin | 40/159 |
| 2,889,647 | 6/1959 | Roman | 40/159 |
| 3,265,072 | 8/1966 | Gross | 40/534 |
| 4,365,433 | 12/1982 | Buell | 40/159 |

*Primary Examiner*—John J. Wilson

*Attorney, Agent, or Firm*—Spensley, Horn, Jubas & Lubitz

[57] ABSTRACT

An apparatus for storing, displaying and identifying photographs having a plurality of transparent, overlapping pockets provided with adjacent opaque writing surfaces for carrying information pertinent to photographs held therein is described. In the preferred embodiment, each pocket is formed of a folded transparent member which is attached along the fold to a backing member. The transparent member thereby forms two transparent panels. Between the panels an opaque sheet is inserted which extends slightly beyond the edges of the panels. An adhesive-backed opaque strip having a surface which may be written upon is placed over the edge of the opaque sheet and the edges of the transparent panels, thereby forming a pocket having two compartments and opaque writing surfaces which do not substantially block photographs held in the compartments.

3 Claims, 5 Drawing Figures

APPARATUS FOR STORING, DISPLAYING AND IDENTIFYING PHOTOGRAPHS

BACKGROUND OF THE INVENTION

1. Field of the Invention

This invention relates to the field of apparatuses for storing photographs in a manner in which the photographs may be viewed with relative ease, the apparatuses being of the type commonly referred to as photo albums.

2. Prior Art

Apparatuses and devices for the storage and display of photographs have taken many forms. One form often referred to as a photo album comprises rigid panels foldable over one another, at least one of the panels having a plurality of flat transparent plastic pockets for holding the photographs. The pockets may display a photograph on each side. Typically, the pockets are attached in a parallel fashion to the rigid panel with a small spacing between adjacent pockets so that the pockets substantially overlap one another when they are laid flat in the album. Thus, when the album is opened, only a photograph contained in the top pocket will be visible to the viewer. To view the other photographs, the viewer flips the pockets. While such a device permits a fairly compact storage of photographs which may be used without much difficulty, problems with respect to the identification of the individual photographs and, relatedly, with the ready access of a particular desired photograph persist.

One approach to identifying the photographs in such a photo album is to print or write the identification of the particular photograph on the back of the photograph. However, such writing on the back of photographs has been known to result in damage or destruction to the photograph. In addition, such an approach precludes the placing of a photograph on each side of the transparent plastic pocket as then the writing will be blocked.

Other approaches have been to glue small pieces of paper having the required information to the face of the pocket or to slip such a piece of paper within the pocket over the photograph. Both of these approaches are unsatisfactory in that such pieces of paper inevitably block part of the photograph.

Another approach that has been used in order to provide identification for the photographs displayed in such an album is to attach an index to the rigid backing member below the bottommost plastic pocket. This index may comprise a series of numbers corresponding to the pockets with spaces adjacent thereto for writing or printing information pertinent to the displayed photos. Unfortunately, after selecting a desired photograph from such an index, a viewer must still search for the desired photograph as the pockets containing the photographs are not numbered.

SUMMARY OF THE INVENTION

A major objective of the present invention is to provide in a storage and display apparatus for photographs a readily useable means for identifying the photographs and for permitting quick access to a desired photograph.

To achieve this objective, the present invention provides an apparatus having a plurality of flippable, overlapping pockets having transparent panels through which photographs may be displayed and a strip of opaque material adjacent to the edge of the pocket opposite to that by which the pocket is attached to a backing member on which may be written desired information pertaining to the photograph.

The unique construction of the pockets for displaying photographs in the present invention not only permits desired photographs to be identified and readily accessed, but permits the opaque writing surface to be provided adjacent to the photograph with very minimal or nonexistent blockage of the photograph itself. In the preferred embodiment, a pocket for photographs comprises two transparent panels formed from a transparent member folded in half and attached at the fold to the backing element. An opaque sheet is inserted between the two transparent panels and against the fold. The opaque sheet at its edge opposite to that placed against the fold extends slightly beyond the edges of the transparent panels opposite the fold. A strip of a material having an opaque writing surface on one side and adhesive backing on the other is placed along the edge of the opaque sheet and folded over with its adhesive backed side onto each side of the opaque sheet and onto a small portion of the transparent panels, thereby forming a pocket having two compartments open at the ends into which photographs may be inserted and displayed through the transparent panels.

It will be appreciated from the above summary that the opaque strip, while on each side of the pocket providing a surface of sufficient size upon which information may be printed or written, does not substantially block a photograph placed within the pocket as only a narrow portion of the strip on each side of the pocket actually contacts the transparent panel; the rest of the opaque strip adheres to the opaque sheet which extends beyond the transparent panels; a photograph cannot be placed between the opaque sheet and the opaque strip except with respect to the narrow portion of the opaque strip contacting the transparent panel.

An apparatus for storing and displaying photographs having an opaque writing surface adjacent a transparent panel as described may be used in conjunction with an index of the type which has previously been known. Such an index may be advantageously positioned under the bottommost flippable pocket. Such an index may be used for auxiliary information or serve to assist in accessing desired photographs by providing an easily scanned index after which the information provided on the opaque writing strips of the flippable pockets may then be used to precisely locate the desired photograph.

DETAILED DESCRIPTION OF A PREFERRED EMBODIMENT

In the preferred embodiment of the present invention to be described herein, a plurality of photographic pockets capable of displaying two photographs on opposite sides is provided. The pockets are attached along one edge to a rigid backing member. Adjacent to the opposite edge of the pockets and the transparent panels of the pockets are located opaque writing strips along which information pertinent to the photographs displayed may be printed or written. The pockets are pivotally attached to the rigid backing member in a parallel manner at equal intervals along the rigid backing member so that when the pockets are all flipped in the same direction, the opaque writing strips on one side of the pockets are all simultaneously in view. Additionally, the preferred embodiment has an opaque writing surface provided on the rigid backing member beneath the bottommost pocket. Additional information concerning the displayed photographs may be placed on an index provided on such a surface and viewed by flipping the pockets in a direction away from such surface.

The preferred embodiment described herein uses a pocket for displaying photographs which not only provides the opaque writing strip adjacent to the photograph without any significant blockage of the photograph, but does so by means of an efficient and simple construction.

The two transparent panels of the present invention are actually formed from a single piece of transparent material which is folded in half along its center. This transparent member is attached to the rigid backing member along the length of the fold by means of an adhesive-backed strip.

A sheet of opaque material is inserted between the two transparent panels formed by folding the transparent member with one edge of the sheet placed adjacent to the fold. The opposite edge of the opaque sheet extends slightly beyond the edges of the transparent panels opposite the fold. In the preferred embodiment, this edge of the opaque sheet extends beyond the edges of the transparent panels by between approximately one-eighth and one-quarter of an inch.

A strip of adhesive-backed material is then placed along its center line against this edge of the opaque sheet and folded over on to each side of the opaque sheet and onto a small portion of the transparent panel. The opaque strip has a width slightly greater than twice the amount by which the opaque sheet extends beyond the edges of the transparent panels so that the opaque strip contacts a small portion of these panels when it is folded over. A pocket having two compartments is thereby formed. It will be appreciated that such a pocket, while providing an opaque surface upon which information may be printed or written, does so without blocking any significant portion of a displayed photograph.

Figure 1:
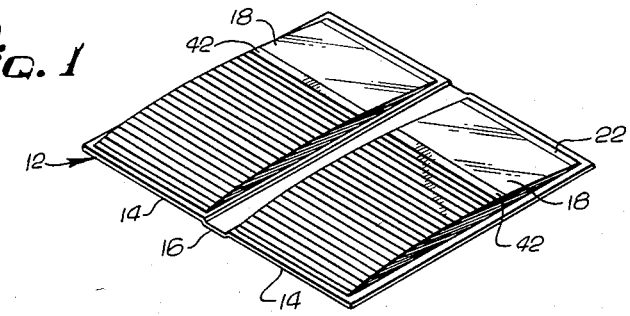
FIG. 1 is a perspective view of a preferred embodiment of the present invention.

Referring now to the drawings, a detailed description of a preferred embodiment will now be given. As seen in FIG. 1, the preferred embodiment to be described herein comprises a cover formed of two rigid backing members 14 joined by a binding member 16 which is pivotally attached along its sides to the rigid backing members 14 so that the cover 12 may be opened and closed in somewhat of a booklike manner.

On each rigid backing member 14 is located a plurality of pockets 18 for holding photographs. The pockets 18 are attached along a first edge 20 to the rigid backing member 14. An adhesive backed strip of material 22 is used to attach the first edge 20 of each pocket 18 to the rigid backing member 14. The flexibility of the strip of material 22 permits the pocket 18 to be pivoted about the first edge 20. Thus, the pockets 18 may be flipped upwards such as is shown on the right side of FIG. 2 or downwards such as is shown on the left side of FIG. 2 and in FIG. 3, the latter being the position of the pockets 18 when the cover 12 is closed.

Figure 5:
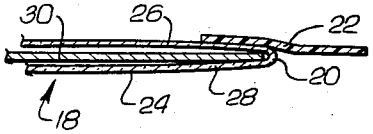
FIG. 5 is a detailed cross-sectional view of the preferred embodiment of the present invention taken in the area of 5, in FIG. 3, and particularly illustrating the construction of the pockets in the area of their attachment to the rigid backing member.

The sides of each pocket 18 are formed from a rectangular transparent member 24 which is folded along its center. As seen in FIG. 5, this fold forms the first edge 20 of the pocket 18 which is attached to the rigid backing member 14. Thus, two transparent panels 26 and 28 are formed from the transparent member 24.

Figure 4:
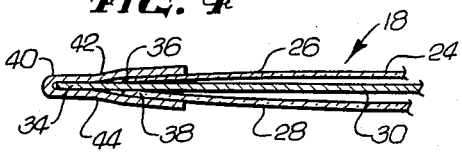
FIG. 4 is a detailed cross-sectional view of the preferred embodiment of the present invention taken in the area of 4, in FIG. 3, and particularly illustrating the construction of the pockets in the area of the opaque writing strips.

An opaque sheet 30 having the same width as the transparent members 26 and 28 is inserted between those members so that its first edge 32 presses against the fold which forms the first edge 20 of the pocket 18. As seen in FIG. 4, opaque sheet 30 is sized so that its second edge 34 opposite first edge 32 extends slightly beyond and parallel to the edges 36 and 38 of the transparent panels opposite the fold forming the first edge 20.

An opaque strip of material 40 having adhesive material on one side and a surface suitable for writing upon on the other side is placed along its center line against second edge 34. Opaque strip 40 is placed with its surface having adhesive material toward opaque sheet 30. Opaque strip 40 has a width on each side of its center line slightly greater than the amount by which the second edge 34 of opaque sheet 30 extends beyond the edges 36 or 38 of the transparent members 26 or 28 so that when opaque strip 40 is folded over it adheres to the portions of opaque sheet 30 which extend beyond the edges 36 and 38 of the transparent panels 26 and 28 respectively and to a small portion of the transparent panels 26 and 28 adjacent to the edges 36 and 38 respectively. A pocket 18 is formed thereby having two compartments separated by opaque sheet 30.

The opaque strip of material 40 folded over the second edge 34 of opaque sheet 30 as described forms two opaque writing surfaces 42 and 44 on each side of pocket 18. However, the opaque writing surfaces 42 and 44 do not block the transparent panels 26 and 28 to any significant degree as only very narrow portions of the opaque strip 40 contact the transparent panel 26 and 28 adjacent their second edges 36 and 38 respectively. Most of the opaque strip 40 which forms the opaque writing surfaces 42 and 44 adheres to the opaque sheet 30 adjacent to its second edge 34 on either side. Therefore, even if a photograph not having borders around it is placed within the compartments of the pocket 18, very little of the photograph will be blocked by the opaque writing surfaces 42 and 44 on the pocket 18.

It will be appreciated from the above description that the use of opaque sheet 30 provides two readily discernible advantages. First, since most of the opaque writing surfaces 42 and 44 which are formed from the opaque strip of material 40 overlap the opaque sheet 30 and adhere thereto rather than to the transparent panels 26 and 28 adjacent the edges 36 and 38 respectively, very little of the transparent panels 26 and 28 are blocked by the opaque writing surfaces 42 and 44 respectively. Second, the use of the opaque sheet 30 helps to facilitate construction of the pocket 18 in that the second edge 34 of the opaque sheet 30 is an edge against which the strip of material 40 may be located before being folded over onto either side of the opaque sheet 30 and transparent panels 26 and 28 as has been described.

A pocket 18 formed as has been described, is open at the ends adjacent to the first edge 20 and the edges 36 and 38 of the transparent panels 26 and 28 respectively so that photographs may be slipped into each compartment of the pocket 18 and displayed through the transparent panels 26 and 28.

Pockets 18 having the construction described are disposed at equal intervals along the rigid backing member 14. The spacing between the first edges 20 at which the pockets 18 are attached to the rigid backing member 14 is such that when the pockets 18 are flipped in the same direction, they overlap one another but leave the opaque writing surface 42 or 44, depending on which way the pockets 18 are flipped, exposed so that information written or printed on the opaque writing surface 42 or 44 of each pocket 18 may be scanned or read.

Figure 2:
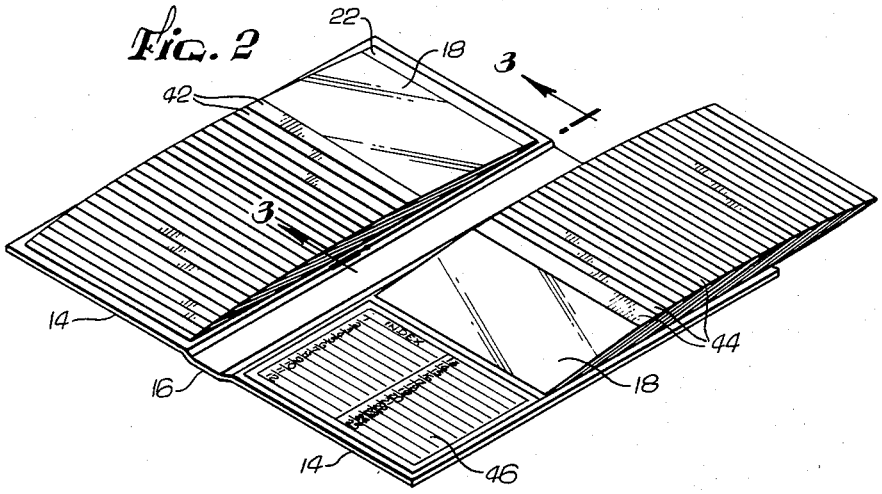
FIG. 2 is a perspective view of the preferred embodiment of the present invention in which the photographic pockets on the right side have all been flipped to display an auxillary index.
Figure 3:
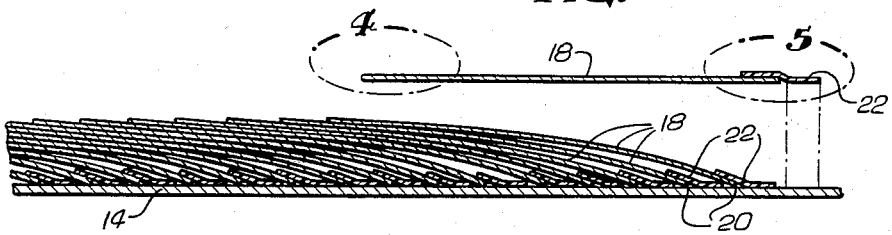
FIG. 3 is a cross-sectional, partially disassembled view of a portion of the present invention taken along the lines 3—3 in FIG. 2.

Additionally, the preferred embodiment has an opaque writing panel 46 on the rigid backing member 14. This may be located as shown in FIG. 2 near the bottom of backing member 14 so that it is not visible when pockets 18 are flipped as shown in FIG. 1. The opaque writing panel 46 may be provided with numbered spaces corresponding to the various pockets 18 attached to the rigid backing member 14. Thus, information concerning a particular photograph displayed may be entered on the opaque writing surface 42 and 44 corresponding to the side of the pocket 18 in which the photograph is placed as well as on the opaque writing panel 46.

It will be appreciated from the above description that the described preferred embodiment is but one variation of the present invention. For example, it is not necessary to use a single transparent member 24 to form the transparent panels 26 and 28; separate transparent members could be used for such purpose. In addition, while use of the opaque sheet 30 provides certain advantages as has been described, opaque writing surfaces which do not significantly block the transparent panels 26 and 28 could be formed without the use of opaque sheet 30. However, it would be necessary to precisely locate the strip of material 40 before folding it over upon itself and the portions of the transparent panels 26 and 28 adjacent the second edges 36 and 38 respectively. Thus, the present invention is not limited to the preferred embodiment described herein.

I claim:

1. A flippable pocket for a photo album having a backing member to which the pocket is attachable at a first edge thereof comprising:

a transparent member having a fold along its center, said fold forming said first edge and dividing said member into two transparent panels, each having an edge opposite the fold;

an opaque sheet placed between said transparent panels with a first edge against the fold and a second edge extending slightly beyond the edges of the transparent panels opposite the fold; and an adhesive-backed opaque strip having a surface for writing upon and a width slightly greater than twice the distance that said opaque sheet extends beyond the edges of the transparent panels opposite the fold, said strip centered on said second edge and folded over upon and adhering to said opaque sheet and said transparent panels adjacent their edges opposite the fold, whereby a pocket having two compartments for holding photographs and opaque writing surfaces which do not substantially block photographs placed within the compartments is formed.

2. An apparatus for storing photographs or the like comprising:

a backing member;

a plurality of flippable, overlapping, transparent pockets for holding photographs, each said pocket having first and second opposing edges and two transparent panels therebetween, said transparent panels forming two opposing sides of said pocket for viewing therethrough one or more photographs held in said pocket, said transparent panels formed from a transparent member by folding said member in half, the fold of said transparent member forming the first edge of said pocket and the edges of said transparent panel opposite said fold extending toward said second edge of said pocket, each said pocket having two opposing opaque writing strips, each strip adjacent said second edge of said pocket and one of the two transparent members, said opaque writing strips for placement thereon of information pertinent to the one or more photographs held in said pocket, each said pocket having its second edge and the two opposing opaque writing surfaces formed of a single strip of material folded along its length and adhesively attached to each said transparent panel along the edge opposite said fold of said transparent member, each said pocket having an opaque panel located between said two transparent panels, said opaque panel having a first edge placed against the fold of said transparent member and the second edge opposite said first edge extending further toward said second edge of said pocket than the edges of said transparent panels and adhesively attached on each side to said single strip of material, whereby each pocket has two compartments for holding photographs, said pockets being pivotally attached to said backing member in parallel spaced-apart alignment with one another along their first edges, said pockets being flippable along said first edges so that said pockets overlap one another when flipped in the same direction.

3. An apparatus as in claim 1 wherein said pockets are equally sized rectangles and wherein adjacent first edges of said pockets are equally spaced at a distance so that said opaque writing strips are at least partly visible when said pockets are flipped in the same direction to overlap one another.

* * * * *